US011107410B2

(12) United States Patent
Yuan et al.

(10) Patent No.: US 11,107,410 B2
(45) Date of Patent: Aug. 31, 2021

(54) PIXEL CIRCUIT AND METHOD OF CONTROLLING THE SAME, DISPLAY PANEL AND DISPLAY DEVICE

(71) Applicants: Hefei BOE Joint Technology Co., Ltd., Hefei (CN); BOE TECHNOLOGY GROUP CO., LTD., Beijing (CN)

(72) Inventors: Zhidong Yuan, Beijing (CN); Yongqian Li, Beijing (CN); Can Yuan, Beijing (CN); Chao Jiao, Beijing (CN)

(73) Assignees: HEFEI BOE JOINT TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/856,803

(22) Filed: Apr. 23, 2020

(65) Prior Publication Data

US 2021/0049964 A1 Feb. 18, 2021

(30) Foreign Application Priority Data

Aug. 15, 2019 (CN) ..... 201910754905.0
Aug. 15, 2019 (CN) ..... 201910755664.1

(51) Int. Cl.
*G09G 3/3258* (2016.01)

(52) U.S. Cl.
CPC ... *G09G 3/3258* (2013.01); *G09G 2300/0809* (2013.01); *G09G 2310/06* (2013.01); *G09G 2330/027* (2013.01)

(58) Field of Classification Search
CPC ..... G09G 3/3258; G09G 3/3233; G09G 2300/0809; G09G 2300/0819;
(Continued)

(56) References Cited

U.S. PATENT DOCUMENTS 9,076,387 B1 7/2015 Lee et al.
9,129,554 B2 9/2015 Kim et al.
(Continued)

FOREIGN PATENT DOCUMENTS

CN 103165078 A 6/2013
CN 103165079 A 6/2013
(Continued)

OTHER PUBLICATIONS

First Chinese Office Action dated Jun. 3, 2020, for corresponding Chinese Application No. 201910755664.1.
(Continued)

*Primary Examiner* — Tom V Sheng
(74) *Attorney, Agent, or Firm* — Kinney & Lange, P.A.

(57) ABSTRACT

The present disclosure discloses a pixel circuit and a method of controlling the same. The pixel circuit includes: a light-emitting control sub-circuit, configured to transmit a data voltage at a data signal terminal to a first node under control of a first control terminal; a driving sub-circuit, configured to transmit a first power supply voltage at a first power supply terminal VDD to a second node N2 under control of a voltage at the first node; a first sensing sub-circuit, configured to maintain a voltage at the second node to be at a fixed level under control of the first control terminal; a second sensing sub-circuit, configured to transmit the voltage at the second node to a first sensing signal terminal under control of a second control terminal, so that the first sensing signal terminal senses a voltage associated with a threshold voltage of the driving sub-circuit.

19 Claims, 8 Drawing Sheets

(58) Field of Classification Search
CPC ..... G09G 2310/06; G09G 2320/0295; G09G 2320/0233; G09G 2320/043; G09G 2330/027
USPC ..... 345/211
See application file for complete search history.

(56) References Cited

U.S. PATENT DOCUMENTS

| | | | | |
|---|---|---|---|---|
| 9,437,167 | B2 | 9/2016 | Shin et al. | |
| 9,489,895 | B2 | 11/2016 | Kim et al. | |
| 9,524,678 | B2 | 12/2016 | Bae et al. | |
| 9,679,516 | B2 * | 6/2017 | Chung | G09G 3/3225 |
| 9,812,061 | B2 * | 11/2017 | Liu | G09G 3/3233 |
| 2010/0013747 | A1 | 1/2010 | Honda | |
| 2012/0299978 | A1 * | 11/2012 | Chaji | G09G 3/006 345/690 |
| 2014/0160093 | A1 * | 6/2014 | Chaji | G09G 3/3233 345/204 |
| 2014/0176401 | A1 * | 6/2014 | Kim | G09G 3/3208 345/76 |
| 2015/0123953 | A1 * | 5/2015 | Shim | G09G 3/3233 345/205 |
| 2016/0012799 | A1 | 1/2016 | Kim | |
| 2016/0267839 | A1 | 9/2016 | Yang | |
| 2017/0061877 | A1 | 3/2017 | Lee | |
| 2017/0069273 | A1 | 3/2017 | Park | |
| 2017/0193906 | A1 * | 7/2017 | Li | G09G 3/3258 |
| 2017/0316738 | A1 * | 11/2017 | Sohn | G09G 3/3225 |
| 2018/0061314 | A1 * | 3/2018 | Kim | G09G 3/3233 |
| 2018/0061913 | A1 * | 3/2018 | Kim | H01L 27/3244 |
| 2018/0322829 | A1 * | 11/2018 | Xie | G09G 3/3233 |
| 2019/0035334 | A1 * | 1/2019 | Lin | G09G 3/3258 |
| 2019/0066588 | A1 * | 2/2019 | Lin | G09G 3/3258 |
| 2019/0096326 | A1 * | 3/2019 | Yuan | G09G 3/3258 |
| 2019/0147801 | A1 * | 5/2019 | Chu | G09G 3/3233 345/76 |
| 2020/0027516 | A1 * | 1/2020 | Feng | G09G 3/3266 |
| 2020/0051500 | A1 * | 2/2020 | Lin | G09G 3/3233 |
| 2020/0105191 | A1 * | 4/2020 | Chen | G09G 3/006 |
| 2020/0105197 | A1 * | 4/2020 | Yin | G09G 3/3291 |
| 2020/0127077 | A1 * | 4/2020 | Son | G09G 3/3291 |
| 2020/0160784 | A1 * | 5/2020 | Xu | G09G 3/3233 |
| 2020/0184902 | A1 * | 6/2020 | Kim | G09G 3/3291 |
| 2020/0202777 | A1 * | 6/2020 | Lee | G09G 3/20 |
| 2020/0234647 | A1 * | 7/2020 | Lin | G09G 3/3275 |
| 2020/0251068 | A1 * | 8/2020 | Chen | G09G 5/008 |
| 2020/0312246 | A1 * | 10/2020 | Xu | G09G 3/3258 |

FOREIGN PATENT DOCUMENTS

| | | | |
|---|---|---|---|
| CN | 104637443 | A | 5/2015 |
| CN | 104751778 | A | 7/2015 |
| CN | 104835469 | A | 8/2015 |
| CN | 105321446 | A | 2/2016 |
| CN | 107086025 | A | 8/2017 |
| EP | 3648091 | A1 | 5/2020 |

OTHER PUBLICATIONS

First Chinese Office Action dated Jun. 22, 2020, for corresponding Chinese Application No. 201910754905.0.

* cited by examiner

PIXEL CIRCUIT AND METHOD OF CONTROLLING THE SAME, DISPLAY PANEL AND DISPLAY DEVICE

CROSS-REFERENCE TO RELATED APPLICATION(S)

This application claims priority to the Chinese Patent Application No. CN201910755664.1, filed on Aug. 15, 2019 and the Chinese Patent Application No. CN201910754905.0, filed on Aug. 15, 2019, which are incorporated herein by reference in their entireties.

TECHNICAL FIELD

The present disclosure relates to the field of display technology, and more particularly, to a pixel circuit and a method of controlling the same, a display panel, and a display device.

BACKGROUND

Active-Matrix Organic Light-Emitting Diodes (AMOLEDs) will become a mainstream choice for next-generation displays due to high contrast, wide viewing angle and high response speed. Generally, in design of pixel circuits of Organic Light-Emitting Diode (OLED) products, in consideration of limitations of processes, the pixel circuits are all designed using Thin Film Transistors (TFTs).

SUMMARY

According to a first aspect of the embodiments of the present disclosure, there is provided a pixel circuit, comprising:

a light-emitting control sub-circuit connected to a data signal terminal, a first control terminal and a first node, and configured to transmit a data voltage at the data signal terminal to the first node under control of the first control terminal;

a driving sub-circuit connected to the first node, a first power supply terminal and a second node, and configured to transmit a first power supply voltage at the first power supply terminal VDD to the second node N2 under control of a voltage at the first node;

a first sensing sub-circuit connected to the first control terminal and the second node, and configured to maintain a voltage at the second node to be at a fixed level under control of the first control terminal;

a second sensing sub-circuit connected to a second control terminal, a first sensing signal terminal and the second node, and configured to transmit the voltage at the second node to the first sensing signal terminal under control of the second control terminal, so that the first sensing signal terminal senses a voltage associated with a threshold voltage of the driving sub-circuit, and a light-emitting unit having an anode connected to the second node, and a cathode connected to a ground terminal, wherein the light-emitting control sub-circuit performs threshold voltage compensation on the driving sub-circuit based on a compensation voltage which is obtained according to the voltage sensed at the first sensing signal terminal under control of the first control terminal.

In an embodiment, the first sensing sub-circuit is also connected to the first sensing signal terminal.

In an embodiment, the pixel circuit further comprises: a first external control circuit having one terminal connected to the first sensing signal terminal, and the other terminal connected to the data signal terminal, and the first external control circuit is configured to assist in performing external threshold voltage compensation on the pixel circuit.

In an embodiment, the first external control circuit comprises a first selection switch, a first direct current signal terminal, and a first control Integrated Circuit (IC), wherein the first selection switch has a first terminal connected to the first sensing signal terminal, and a second terminal selectively connected to the direct current signal terminal and one terminal of the control IC, and is configured to transmit the voltage sensed at the first sensing signal terminal to the control IC, or transmit a signal at the direct current signal terminal to the first sensing signal terminal, and the other terminal of the control IC is connected to the data signal terminal, and the control IC is configured to obtain the compensation voltage according to the voltage sensed at the first sensing signal terminal and provide the compensation voltage to the data signal terminal.

In an embodiment, the first sensing signal terminal and the data signal terminal are the same signal terminal.

In an embodiment, the pixel circuit further comprises a second sensing signal terminal connected to the first sensing sub-circuit.

In an embodiment, the pixel circuit further comprises: a second external control circuit having one terminal connected to the second sensing signal terminal and the other terminal connected to the data signal terminal, and the second external control circuit is configured to assist in performing external threshold voltage compensation on the pixel circuit.

In an embodiment, the second external control circuit comprises a second selection switch, a second direct current signal terminal, and a second control IC, wherein the second selection switch has a first terminal connected to the second sensing signal terminal, and a second terminal selectively connected to the second direct current signal terminal and one terminal of the second control IC, and the second selection switch is configured to transmit a voltage sensed at the second sensing signal terminal to the second control IC during a shutdown sensing phase, or transmit a signal at the second direct current signal terminal to the second sensing signal terminal during a scanning phase, and the other terminal of the second control IC is connected to the data signal terminal, and the second control IC is configured to obtain a compensation voltage according to the voltage sensed at the second sensing signal terminal and provide the compensation voltage to the data signal terminal.

In an embodiment, the pixel circuit further comprises: a third external control circuit which comprises a third selection switch and a third control IC, wherein the third selection switch has a first terminal connected to the first sensing signal terminal, and a second terminal selectively connected to the first sensing signal terminal and one terminal of the third control IC, and is configured to transmit the voltage sensed at the first sensing signal terminal to the third control IC, and the other terminal of the third control IC is connected to the first sensing signal terminal, and the third control IC is configured to obtain the compensation voltage according to the voltage sensed at the first sensing signal terminal and provide the compensation voltage to the data signal terminal.

In an embodiment, the light-emitting control sub-circuit comprises:

a first transistor having a control electrode connected to the first control terminal, a first electrode connected to the data signal terminal, and a second electrode connected to the first node; and a storage capacitor having a first terminal connected to the first node and a second terminal connected to the second node.

In an embodiment, the driving sub-circuit comprises:

a driving transistor having a control electrode connected to the first node, a first electrode connected to the first power supply terminal, and a second electrode connected to the second node.

In an embodiment, the first sensing sub-circuit comprises:

a second transistor having a control electrode connected to the first control terminal, a first electrode connected to the second node, and a second electrode connected to the first sensing signal terminal.

In an embodiment, the second sensing sub-circuit comprises:

a third transistor having a control electrode connected to the second control terminal, a first electrode connected to the second node, and a second electrode connected to the first sensing signal terminal.

In an embodiment, the light-emitting unit is an organic light-emitting diode.

According to a second aspect of the embodiments of the present disclosure, there is provided a display panel, comprising a plurality of pixel circuits described above arranged in a matrix and a gate driving circuit.

In an embodiment, the pixel circuit further comprises a second sensing signal terminal connected to the first sensing sub-circuit, and first sensing sub-circuits of different columns of pixel circuits are connected to the same second sensing signal terminal.

In an embodiment, the pixel circuit comprises an R sub-pixel circuit, a B sub-pixel circuit, and a G sub-pixel circuit, which are connected to the same second sensing signal terminal.

According to a third aspect of the embodiments of the present disclosure, there is provided a display device, comprising: a housing and the display panel described above.

According to a fourth aspect of the embodiments of the present disclosure, there is provided a method of controlling the pixel circuit described above, comprising:

controlling, during a scanning period, to transmit a first data voltage at the data signal terminal to the first node, and controlling the driving sub-circuit to drive the light-emitting unit to emit light; and controlling, during a threshold sensing period, to perform threshold voltage sensing on the driving transistor based on a compensation voltage which is obtained according to a sensed voltage.

In an embodiment, during the threshold sensing period, controlling, during a first phase, a second data voltage at the data signal terminal to be transmitted to the first node, and a voltage at the second node to be maintained at a fixed level, controlling, during a second phase, the first power supply terminal to charge the second node through the driving sub-circuit, controlling, during a third phase, the sensed voltage which is associated with the threshold voltage of the driving transistor to be output, controlling during a fourth phase, the first data voltage at the data signal terminal and a previous threshold voltage to be transmitted to the first node, and the driving sub-circuit to drive the light-emitting unit to emit light.

In an embodiment, the method further comprises:

controlling, during a shutdown sensing period, to transmit a shutdown compensation measurement signal to the first node, and to obtain a threshold voltage of the driving transistor based on the sensed voltage.

BRIEF DESCRIPTION OF THE ACCOMPANYING DRAWINGS

The above and/or additional aspects and advantages of the present disclosure will become apparent and easy to understand from the following description of the embodiments in conjunction with the accompanying drawings, in which.

DETAILED DESCRIPTION

Figure 1:
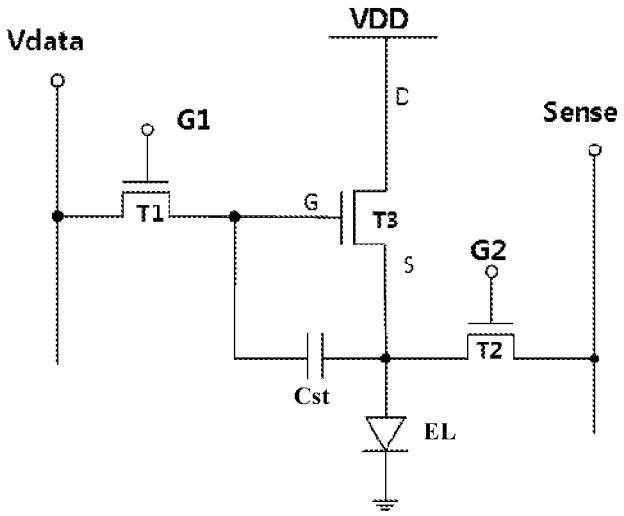
FIG. 1 is a schematic structural diagram of a pixel circuit in the related art.

The embodiments of the present disclosure will be described in detail below. Examples of the embodiments are shown in the accompanying drawings, throughout which the same or similar reference signs indicate the same or similar elements or elements having the same or similar functions. The embodiments described below with reference to the accompanying drawings are exemplary, and are intended to explain the present disclosure, but should not be construed as limiting the present disclosure.

Unless otherwise defined, the technical terms or scientific terms used in the embodiments of the present disclosure should have a common meaning understood by those skilled in the art. The terms "first", "second" and similar words used in the embodiments of the present disclosure do not indicate any order, quantity or importance, but are only used to distinguish different components.

In addition, in the description of the embodiments of the present disclosure, the term "connected" or "electrically connected" may refer to that two components are directly connected or electrically connected, or may refer to that two components are connected or electrically connected via one or more other components. In addition, the two components may be connected or electrically connected in a wired or wireless manner.

Transistors used in the embodiments of the present disclosure may all be thin film transistors, field effect transistors, or other devices having the same characteristics. According to functions in a circuit, the transistors used in the embodiments of the present disclosure are mainly switching transistors. Each of the transistors used in the present disclosure comprises "a control electrode", "a first electrode" and "a second electrode". In an embodiment in which a thin film transistor is used, the control electrode refers to a gate of the thin film transistor, the first electrode refers to one of a source and a drain of the thin film transistor, and the second electrode refers to the other of the source and the drain of the thin film transistor. Since the source and the drain of the thin film transistor used here are symmetrical, the source and the drain may be interchanged. In the following examples, description will be made by taking N-type thin film transistors as an example. Similarly, in other embodiments, the technical solutions according to the present disclosure may also be implemented using P-type thin film transistors. It may be understood by those skilled in the art that in this case, the technical solutions according to the present disclosure may also be implemented by inverting (and/or performing other adaptive modifications to) input signals, clock signals, and constant voltage signals etc.

Further, in the description of the embodiments of the present disclosure, the terms "active level" and "inactive level" are levels which cause a relevant transistor to be turned on and turned off respectively. Hereinafter, since an N-type thin film transistor is used as an example, the "active level" is a high level and the "inactive level" is a low level.

Figure 2:
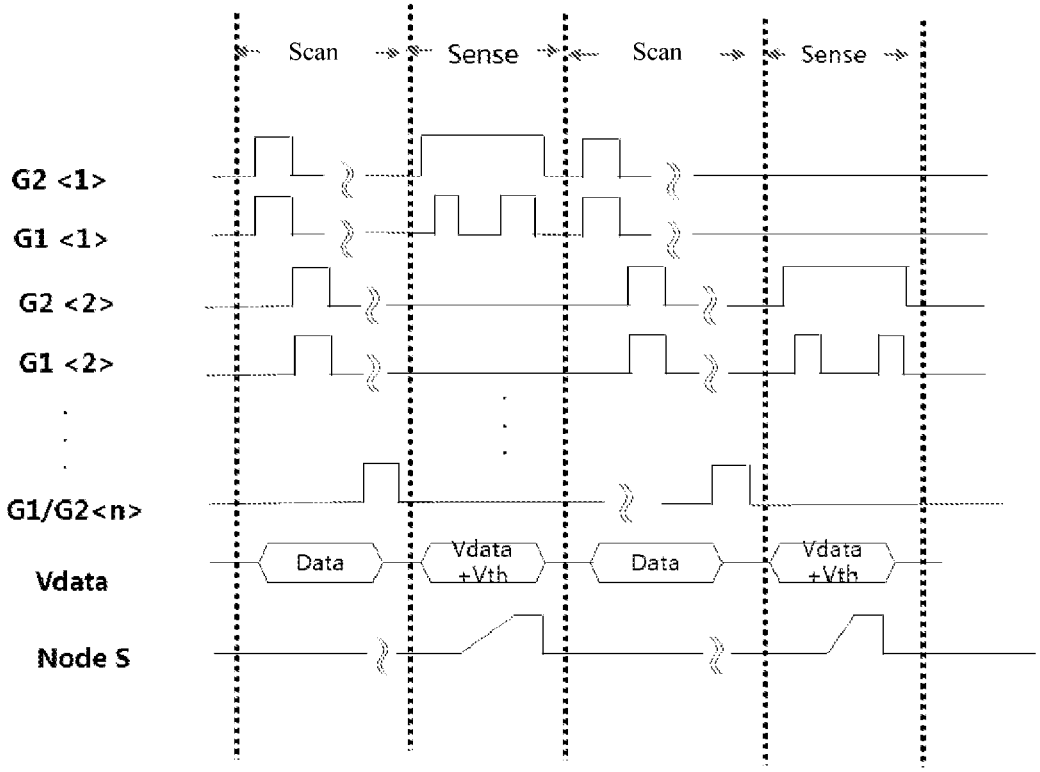
FIG. 2 is a timing diagram of the pixel circuit shown in FIG. 1.
Figure 3:
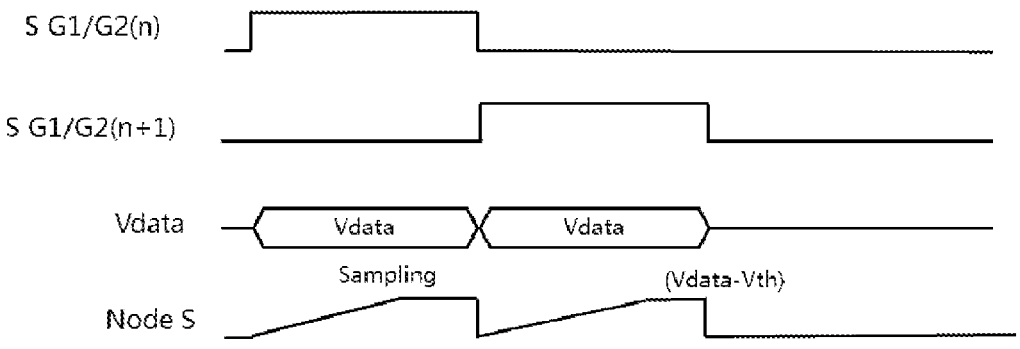
FIG. 3 is a timing diagram of shutdown sensing of the pixel circuit shown in FIG. 1.

In the related art, a pixel circuit is generally implemented using a 3T1C circuit. As shown in FIG. 1, due to the difference in driving transistors T3, the driving transistors T3 need to be corrected through external compensation, and therefore a compensation timing needs to be taken into account in design of display pixels of an AMOLED. FIG. 2 is a timing diagram of compensation of the pixel circuit shown in FIG. 1, and FIG. 3 is a timing diagram of shutdown sensing of the pixel circuit shown in FIG. 1.

It may be seen from FIG. 2 that control terminals G1 and G2 need to be scanned progressively during scanning, which results in an excessively large area of a pixel circuit (which requires double driving signals). This is not conducive to realization of narrow border design of products and causes a high cost. For example, in panel design of a 54.5 AMOLED, which uses the 3T1C circuit shown in FIG. 1, T1 to T3 are first to third transistors, Vdata is a data line, VDD is a direct current power supply, Sense is a sensing line, EL is a light-emitting unit, G1 is a first control terminal, G2 is a second control terminal, and Cst is a capacitor. However, an electroluminescent device is required by the OLED product itself to emit light, and light-emitting current required needs to be provided by the driving transistor T3. Due to the difference in driving transistors, the driving transistors need to be corrected through external compensation, and therefore a compensation timing needs to be taken into account in design of display pixels of the AMOLED.

However, in the related art, as shown in FIG. 1, both the driving signals G1 and G2 need to be scanned progressively during scanning, which results in an excessively large area of the pixel circuit (which requires double driving signals). This is not conducive to realization of a narrow border design of products and causes a high cost.

The pixel circuit, the display panel, and the display device according to the embodiments of the present disclosure will be described below with reference to the accompanying drawings.

Figure 4:
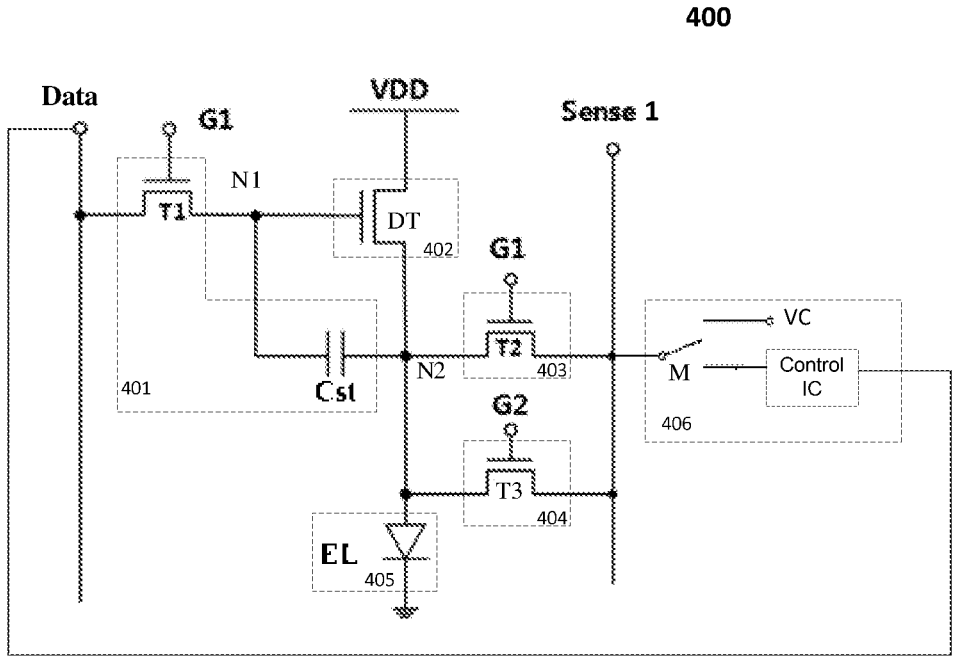
FIG. 4 is a structural diagram of a pixel circuit according to an embodiment of the present disclosure.

FIG. 4 is a structural diagram of a pixel circuit 400 according to an embodiment of the present disclosure. As shown in FIG. 4, the pixel circuit 400 comprises a light-emitting control sub-circuit 401, a driving sub-circuit 402, a first sensing sub-circuit 403, a second sensing sub-circuit 404, a light-emitting unit 405 and a first external control circuit 406.

The light-emitting control sub-circuit 401 is connected to a data signal terminal Data, a first control terminal G1, and a first node N1, and is configured to transmit a data voltage at the data signal terminal Data to the first node N1 under control of the first control terminal G1.

The driving sub-circuit 402 is connected to the first node N1, a first power supply terminal VDD and a second node N2, and is configured to transmit a first power supply voltage at the first power supply terminal VDD to the second node N2 under control of a voltage at the first node N1.

The first sensing sub-circuit 403 is connected to the first control terminal G1 and the second node N2, and is configured to maintain a voltage at the second node N2 to be at a fixed level under control of the first control terminal G1.

The second sensing sub-circuit 404 is connected to a second control terminal G2, a first sensing signal terminal Sense 1 and the second node N2, and is configured to transmit the voltage at the second node N2 to the first sensing signal terminal Sense 1 under control of the second control terminal G2, so that the first sensing signal terminal Sense 1 senses a voltage associated with a threshold voltage Vth of the driving sub-circuit.

The light-emitting unit 405 has an anode connected to the second node N2, and a cathode connected to a ground terminal.

In an embodiment, the first sensing sub-circuit 403 is also connected to the first sensing signal terminal Sense1.

The pixel circuit 400 further comprises a first external control circuit 406. Specifically, the first external control circuit 406 has one terminal connected to the first sensing signal terminal Sense 1 and the other terminal connected to the data signal terminal Data. The first external control circuit 406 is configured to assist in performing external threshold voltage compensation on the pixel circuit 400.

In an embodiment, threshold voltage compensation is performed on the driving sub-circuit 402 based on a compensation voltage which is obtained according to the voltage sensed at the first sensing signal terminal Sense 1.

In some embodiments, when the threshold voltage compensation is performed on the driving sub-circuit 402 by designing the second sensing sub-circuit 404, it only needs to scan the second control terminal G2 during a compensation period without progressive shift design for the second control terminal G2, so that only one CLK is required by G2. A layout space occupied by the pixel circuit is greatly reduced, so that not only a narrow bezel of the product may be realized, but also the cost may be reduced.

In an embodiment, as shown in FIG. 4, the light-emitting control sub-circuit 401 comprises: a first transistor T1 having a first electrode connected to the data signal terminal Data, a control electrode connected to the first control terminal G1, and a second electrode connected to the first node N1; and a storage capacitor Cst having a first terminal connected to the first node N1 and a second terminal connected to the second node N2.

The driving sub-circuit 402 comprises a driving transistor DT having a control electrode connected to the first node N1, a first electrode connected to the first power supply terminal VDD, and a second electrode connected to the second node N2.

The first sensing sub-circuit 403 comprises a second transistor T2 having a control electrode connected to the first control terminal G1, a first electrode connected to the second node N2, and a second electrode connected to the first sensing signal terminal Sense 1.

The second sensing sub-circuit 404 comprises a third transistor T3 having a control electrode connected to the second control terminal G2, a first electrode connected to the second node N2, and a second electrode connected to the first sensing signal terminal Sense 1.

The first external control circuit 406 comprises a first selection switch M1, a direct current signal terminal VC, and a control Integrated Circuit (IC). The first selection switch M1 has a first terminal connected to the first sensing signal terminal Sense 1, and a second terminal selectively connected to the direct current signal terminal VC and one terminal of the control IC, and the first selection switch M1 is configured to transmit the voltage sensed at the first sensing signal terminal Sense 1 to the control IC or transmit a signal at the direct current signal terminal VC to the first sensing Signal terminal Sense 1. The other terminal of the control IC is connected to the data signal terminal Data, and the control IC is configured to obtain the compensation voltage according to the voltage sensed at the first sensing signal terminal and provide the compensation voltage to the data signal terminal Data. In the present embodiment, the first selection switch M1 may be an either-or selection switch, but the embodiments of the present application are not limited thereto.

It should be illustrated that in an implementation of the present disclosure, the first transistor T1, the second transistor T2, the third transistor T3, and the driving transistor DT may be Thin Film Transistors (TFTs), and the first transistor T1, the second transistor T2, the third The transistor T3 and the driving transistor DT may be N-type transistors or P-type transistors. The light-emitting unit 405 may be an Organic Light-Emitting Diode (OLED).

Figure 5:
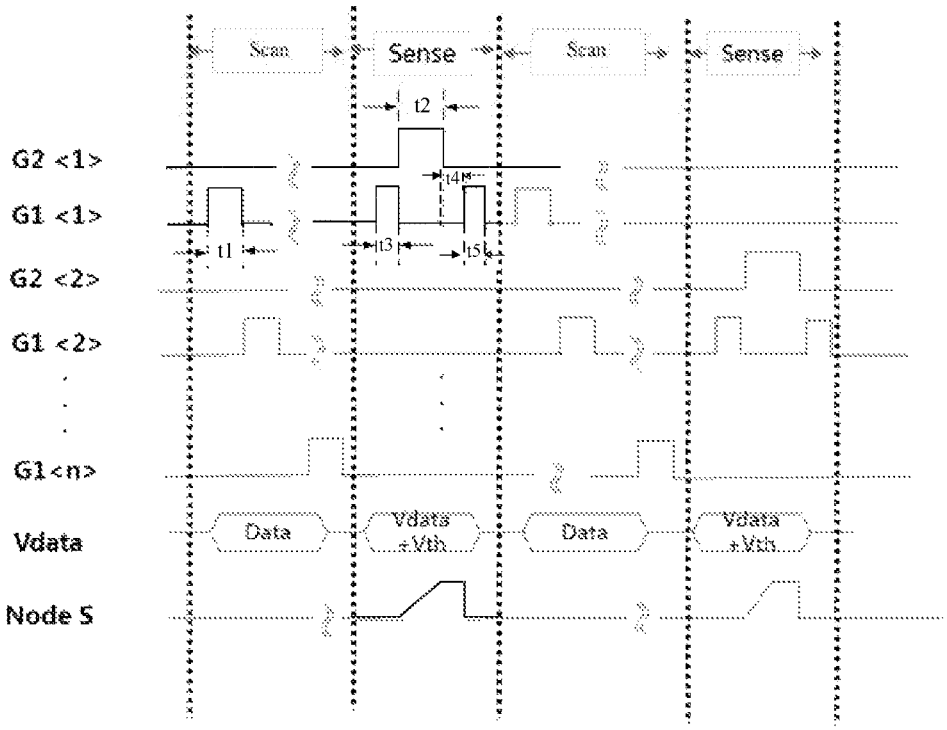
FIG. 5 is an operation timing diagram of the pixel circuit shown in FIG. 4.

Specifically, as shown in FIG. 4, in the present application, a timing at the second control terminal G2 is separated, the first control terminal G1 is used to control the first transistor T1 and the second transistor T2, the second control terminal G2 is used to control the third transistor T3, and control timing diagrams at the first control terminal G1 and the second control terminal G2 may be known with reference to FIG. 5. As shown in FIG. 5, an operation timing of the pixel circuit may comprise two periods, which may be divided into a scanning period and a threshold voltage sensing period. Description will be made by taking an example of the transistors T1 to T3 and DT in the pixel circuit according to the embodiments of the present disclosure being all N-type thin film transistors and being turned on when a signal thereof at a high level is an effective signal. During the scanning period, when an input signal at the first control terminal G1 is at a high level (for example, during a phase t1 in FIG. 5), the first transistor T1 is turned on, and the data signal terminal Data inputs a first data voltage (for example, an image signal to be displayed) having a voltage value of Vdata1, and provides the first data voltage to the first node N1. While the first transistor T1 is turned on, the second transistor T2 is also turned on. At this time, the first data voltage is written into one terminal of the storage capacitor Cst, and is applied to a gate of the driving transistor DT at the same time, so that the driving transistor DT is turned on, to drive a light-emitting unit to emit light. Then, the input signal at the first control terminal G1 is at a low level, the first transistor T1 and the second transistor T2 are turned off at this time, a channel between the data signal terminal Data and the storage capacitor Cst is turned off, and the driving transistor DT is maintained to be turned on and the light-emitting unit is maintained to emit light at this time under the action of the storage capacitor Cst, thereby displaying a picture.

With reference to FIG. 5 here, the threshold voltage sensing period comprises: a phase t2, a phase t3, a phase t4, and a phase t5. In FIG. 5, the phase t3, the phase t2, the phase t4 and the phase t5 occur in a chronological order, and details of theses phases are as follows.

During the phase t3, the input signal at the first control terminal G1 is at a high level, the input signal at the second control terminal G2 is at a low level, and the first transistor T1 is turned on, so that a second data voltage (for example, a preset second data voltage) input at the data signal terminal Data, having a voltage value of Vdata2, is provided to the first node N1. At this time, the second data voltage is written into one terminal of the storage capacitor Cst, so that a voltage across the storage capacitor Cst is the same as Vdata2, and the second data voltage is applied to the gate of the driving transistor DT at the same time. While the first transistor T1 is turned on, the second transistor T2 is also turned on. At this time, the second terminal of the first selection switch M1 is connected to the direct current signal terminal VC, so that a signal Vc at the direct current signal terminal VC may be provided to the second node N2 through the first sensing signal terminal Sense 1 to maintain the voltage at the second node N2 to be at a fixed level (for example, a low level). When a difference between Vdata2 and the voltage at the second node N2 is greater than the threshold voltage Vth of the driving transistor, the driving transistor DT is turned on. During this phase, the first sensing signal terminal Sense 1 is also reset.

During the phase t2, the input signal at the first control terminal G1 is at a low level, the input signal at the second control terminal G2 is at a high level, the first transistor T1 and the second transistor T2 are turned off, and the third transistor T3 is turned on. Since the driving transistor DT is turned on, the first power supply VDD may charge the second node N2, so that the voltage at the second node is associated with the threshold voltage Vth of the driving transistor. In an embodiment, driving current (i.e., current at the second node N2) of the driving transistor DT for driving the light-emitting unit should be $I=k(Vgs-vth)^2$, wherein Vgs is a gate-source voltage of the driving transistor DT, and Vth is the threshold voltage of the driving transistor DT. At this time, the first sensing signal terminal Sense 1 is in a floating state. In an embodiment, Vgs is Vdata2.

During the phase t4, the input signal at the first control terminal G1 is at a low level, the input signal at the second control terminal G2 is at a low level, the first transistor T1, the second transistor T2 and the third transistor T3 are all turned off, and the voltage at the second node N2 is equal to Vdata2−Vth at this time. The first sensing signal terminal Sense 1 senses the voltage at the second node N2. At this time, the second terminal of the first selection switch is connected to the control IC to provide the voltage at the second node N2 which is sensed at the first sensing signal terminal Sense 1 to the control IC. The control IC converts this voltage into a digital signal, stores the digital signal in a memory cell, and obtains the threshold voltage Vth of the driving transistor DT.

During the phase t5, the input signal at the first control terminal G1 is at a high level, the input signal at the second control terminal G2 is at a low level, the first transistor T1 and the second transistor T2 are turned on, and the third transistor T3 is turned off. The first transistor T1 is turned on, the data signal terminal Data inputs a third data voltage having a voltage value which is a data voltage Vdata1 during a previous scanning period plus the previously obtained Vth, and the third data voltage is provided to the first node N1 to control the driving transistor DT to be turned on. At this time, the first sensing signal terminal Sense1 is in a floating state. In an embodiment, the driving transistor DT is turned on under the action of the third data voltage, to drive the light-emitting unit to emit light.

It should be illustrated that, during the phase t3, the second data voltage Vdata2 input at the data signal terminal Data may be a fixed voltage, and ensures that the light-emitting unit does not emit light during this phase, and therefore the second data voltage Vdata2 may be, for example, about 5V. The third data voltage input at the data signal terminal Data during the phase t5 is a compensation voltage which is obtained according to the first data voltage Vdata1 and the threshold voltage Vth which is previously obtained by the control IC, so that the light-emitting unit emits light, and the third data voltage may be compared with a threshold voltage which is obtained during a current threshold voltage sensing period. In addition, the threshold voltage which obtained during the current threshold voltage sensing period is used to realize the threshold voltage compensation on the driving transistor during a subsequent scanning period. In addition, in an embodiment, duration of the threshold voltage sensing period is, for example, 200 to 300 microseconds, and duration of the phase t5 is 3 microseconds for a refresh rate of 120 Hz.

In an embodiment of the present application, when the first transistor and the second transistor are turned on under control of the first control terminal, the first data voltage at the data signal terminal is transmitted to the first node, and the voltage at the second node is maintained to be at a low level. When the first transistor is turned off under control of the first control terminal and the third transistor is turned on under control of the second control terminal, the first power supply terminal charges the second node. When the first transistor is turned off under control of the first control terminal and the third transistor is turned off under control of the second control terminal, the voltage at the second node which is associated with the threshold voltage of the driving transistor is transmitted to the control IC through the first sensing signal terminal to obtain the threshold voltage of the driving transistor. When the first transistor is turned on under control of the first control terminal and the third transistor is turned off under control of the second control terminal, threshold compensation is performed on the driving transistor based on the compensation voltage which is obtained according to the voltage associated with the threshold voltage of the driving transistor.

It should be illustrated that a threshold voltage sensing period between frames may only be used to perform threshold voltage sensing on one row of pixels. For example, a pixel array comprises 1024 rows of pixels, and then threshold voltages of all rows of pixels may be obtained after 1024 frames. In the present application, a specific row of pixels may be designated according to requirements, so as to perform threshold voltage sensing on this row of pixels during a threshold voltage sensing period.

In addition, in the embodiment of the present application, the third transistor is added, the first control terminal G1 is used to control both the first transistor and the second transistor, the second control terminal G2 is used to control the third transistor, and the third transistor only needs to be turned on once when a row of pixels where the pixel circuit is located is selected during the threshold voltage sensing period, so as to sense the threshold voltage of the driving transistor without progressive shift design for the control signal of the third transistor. In the present application, there is no need to make progressive shift design for the control signal of the third transistor T3, which greatly reduces a layout space occupied by the pixel circuit, so that not only a narrow bezel of the product may be realized, but also the cost may be reduced.

Figure 6:
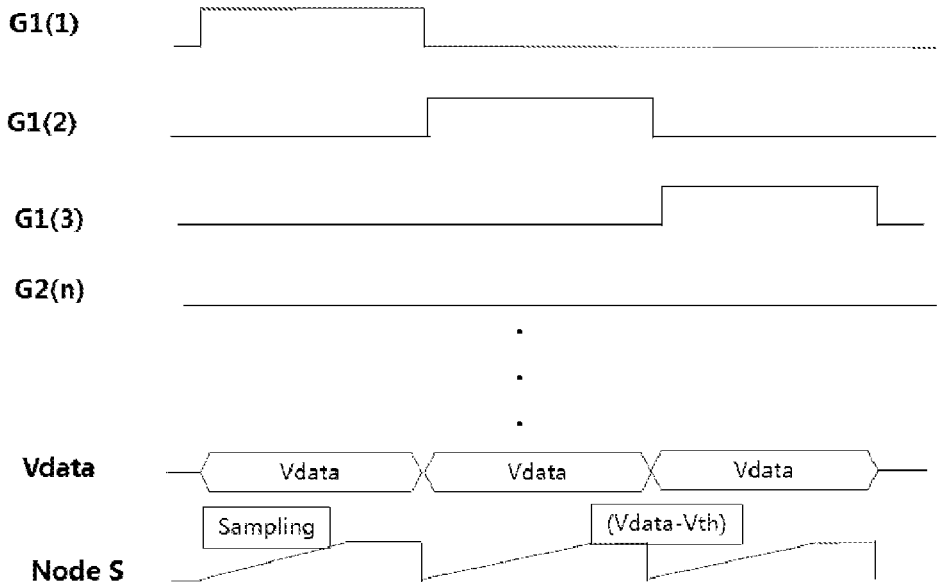
FIG. 6 is a timing diagram of shutdown sensing of the pixel circuit shown in FIG. 4.

Further, in an embodiment of the present disclosure, FIG. 6 is a timing diagram of shutdown sensing of the pixel circuit shown in FIG. 4. In an embodiment, shutdown sensing refers to threshold sensing which is performed in a case where a display device is shut down (for example, the display device does not actually display a picture). As shown in FIG. 6, during a shutdown sensing period, the input signal at the second control terminal G2 is always at a low level, that is, the third transistor T3 is always maintained to be turned off. The first control terminal G1 is at a high level when a row of pixels where the pixel circuit is located is selected, so as to drive the first transistor T1 and the second transistor T2 to be turned on, and read a shutdown measurement signal. At this time, the second terminal of the first selection switch is connected to the control IC to output the voltage at the second node associated with the threshold voltage of the driving transistor, which is sensed at the first sensing signal terminal, to the control IC, to obtain the threshold voltage of the driving transistor. In a specific implementation, when the display device is turned on for display, the threshold voltage of the driving transistor which is obtained during the shutdown sensing period may be used to realize the threshold voltage compensation on the pixel circuit.

It should be illustrated that, during the shutdown sensing period, the second control terminal G2 is always at a low level, so that threshold voltage sensing may be performed on each row of pixels during the shutdown sensing period. In addition, during the shutdown sensing period, the shutdown measurement signal input at the data signal terminal Data is, for example, 3V, and the voltage input to the control IC may be Vdata-Vth. This simplifies an algorithm for obtaining the threshold voltage Vth.

Figure 7:
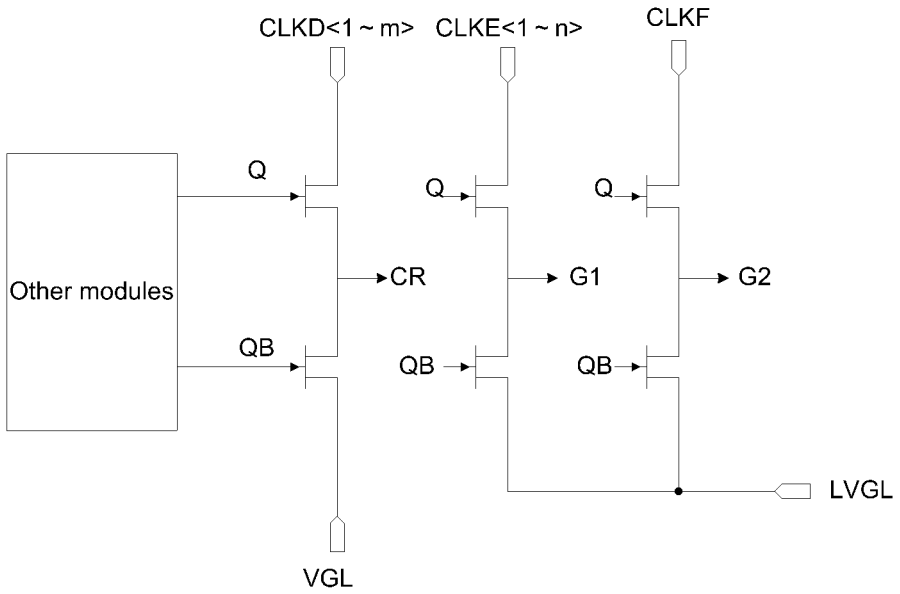
FIG. 7 is a schematic diagram of a driving circuit of the pixel circuit shown in FIG. 4.
Figure 11:
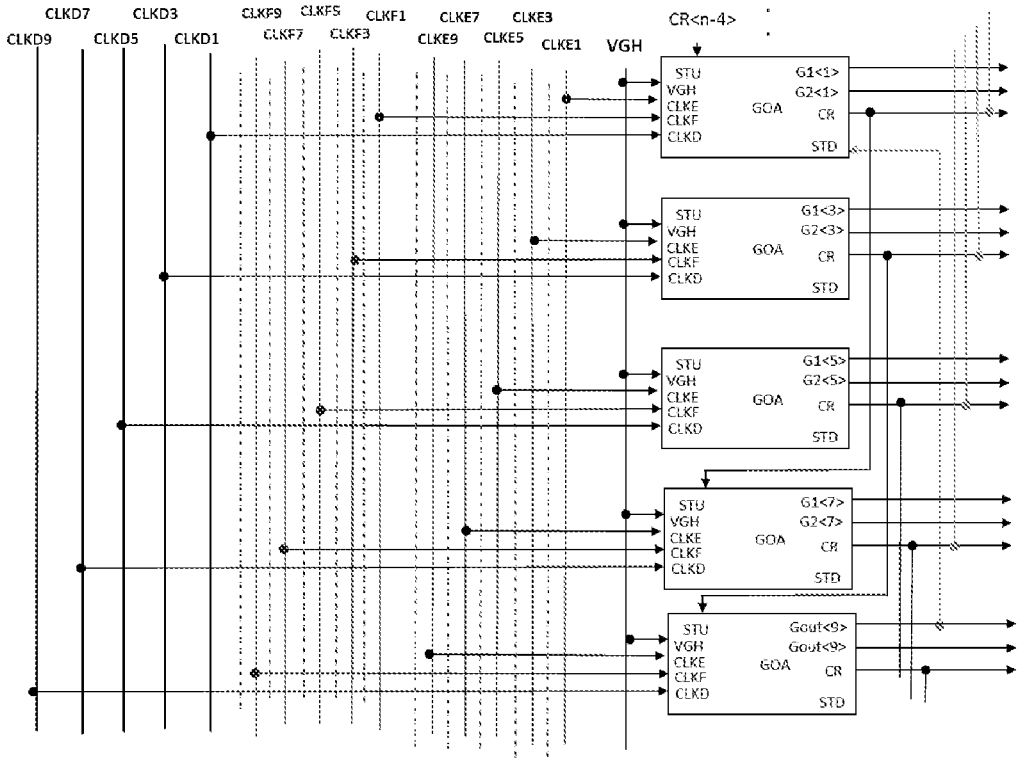
FIG. 11 illustrates a schematic diagram of a gate driving circuit of a pixel circuit in the related art.

In another embodiment, the driving circuit design required for the pixel circuit according to the present disclosure may be realized by reducing n G1 driving signals and n G2 driving signals ($n \geq 2$, and n is a natural number) in the related art to n G1 driving signals and one G2 driving signal, as shown in FIG. 7, which greatly reduces the layout space occupied by the driving circuit of the pixel circuit. As a comparative example, FIG. 11 illustrates a schematic diagram of a gate driving circuit of a 3T1C pixel circuit in the related art. Since in the present application, it does not need to make progressive shift design for the control signal of the third transistor T3 in the pixel circuit, the layout space occupied by the gate driving circuit for driving the pixel circuit may be greatly reduced, for example, a shaded part in FIG. 11 may be omitted, so that not only a narrow bezel of the product may be realized, but also the cost may be reduced.

In summary, in the pixel circuit according to the embodiment of the present disclosure, the third transistor is added, the first control terminal is used to control both the first transistor and the second transistor, the second control terminal is used to control the third transistor, and the third transistor only needs to be turned on once when a row of pixels where the pixel circuit is located is selected during the threshold voltage sensing period, so as to perform voltage compensation without progressive shift design for the control signal of the third transistor, which greatly reduces the layout space occupied by the driving circuit of the pixel circuit, so that not only a narrow bezel of the product may be realized, but also the cost may be reduced.

Figure 8:
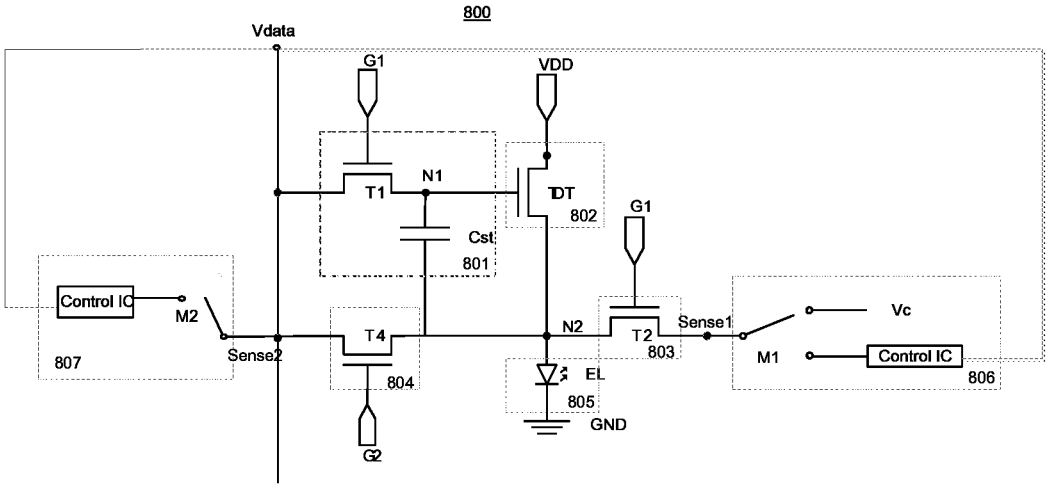
FIG. 8 is a structural diagram of a pixel circuit according to another embodiment of the present disclosure.

Another embodiment of the present disclosure further provides a pixel circuit. As shown in FIG. 8, the pixel circuit 800 comprises a light-emitting control sub-circuit 801, a driving sub-circuit 802, a first sensing sub-circuit 803, a second sensing sub-circuit 804, a light-emitting unit 805, a first external control circuit 807, and a second external control circuit 806. The light-emitting control sub-circuit 801, the driving sub-circuit 802, and the light-emitting unit 805 in the present embodiment are the same as the light-emitting control sub-circuit 401, the driving sub-circuit 402, and the light-emitting unit 405 shown in FIG. 4, and therefore descriptions thereof are omitted here.

The first sensing sub-circuit 803 is connected to a first control terminal G1, a second sensing signal terminal Sense 2 and a second node N2, and is configured to maintain a voltage at the second node N2 to be at a fixed level under control of the first control terminal G1.

The first sensing sub-circuit 803 comprises a second transistor T2 having a control electrode connected to the first control terminal G1, a first electrode connected to the second node N2, and a second electrode connected to the second sensing signal terminal Sense 2.

The second sensing sub-circuit 804 is connected to a second control terminal G2, a first sensing signal terminal Sense1 and the second node N2, and is configured to transmit a voltage at the second node N2 to the first sensing signal terminal Sense 1 under control of the second control terminal G2, so that the first sensing signal terminal Sense 1 senses a voltage associated with the threshold voltage Vth of the driving sub-circuit.

The second sensing sub-circuit 804 comprises a third transistor T3 having a control electrode connected to the second control terminal G2, a first electrode connected to the second node N2, and a second electrode connected to the first sensing signal terminal Sense1.

The first external control circuit 807 comprises a first selection switch M1 and a control IC. The first sensing signal terminal Sense1 is connected to a data signal terminal Data or the control IC through the first selection switch M1. The first selection switch M1 has a first terminal connected to the first sensing signal terminal Sense 1, and a second terminal selectively connected to the data signal terminal Data and one terminal of the control IC, and the first selection switch M1 is configured to transmit the voltage sensed at the first sensing signal terminal Sense 1 to the control IC. The other terminal of the control IC is connected to the data signal terminal Data, and the control IC is configured to obtain a compensation voltage according to the voltage sensed at the first sensing signal terminal and provide the compensation voltage to the data signal terminal Data.

The second external control circuit 806 comprises a second selection switch M2, a direct current signal terminal VC, and a control IC. The second selection switch M2 has a first terminal connected to the second sensing signal terminal Sense 2, and a second terminal selectively connected to the direct current signal terminal VC and one terminal of the control IC, and the second selection switch M2 is configured to transmit a voltage sensed at the second sensing signal terminal Sense 2 to the control IC, or transmit a signal at the direct current signal terminal VC to the second sensing Signal terminal Sense 2. The other terminal of the control IC is connected to the data signal terminal Data. It should be illustrated that the second external control circuit 806 transmits the voltage sensed at the second sensing signal terminal Sense 2 to the control IC during a shutdown sensing period (described later) to obtain the threshold voltage of the driving transistor during the shutdown sensing period and does not operate during a scanning period.

Figure 9:
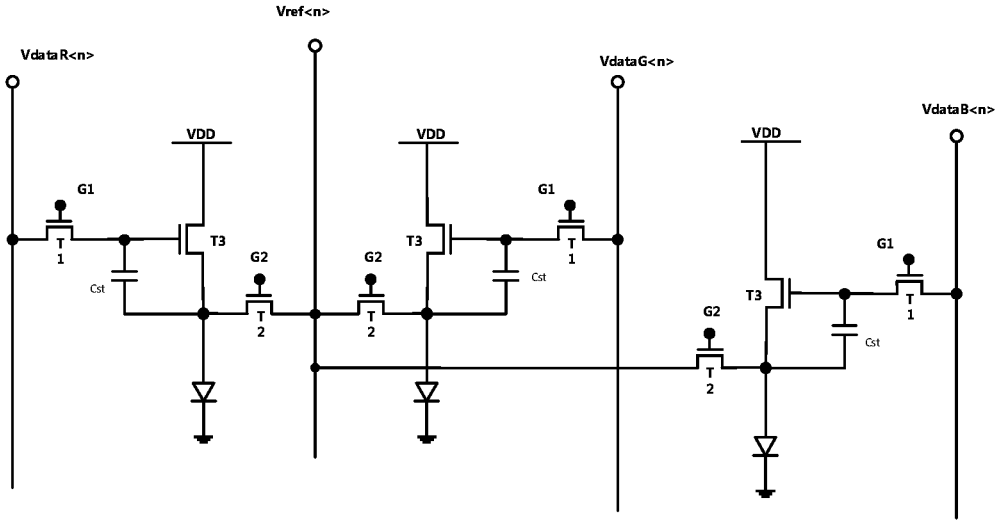
FIG. 9 is architecture of an $n^{th}$ column of pixels of a pixel driving circuit shown in FIG. 1.

In the related art, as shown in FIG. 9, a reference voltage Vef<n> of the pixel circuit may have design such as one Vef<n> for three pixel circuits or even one Vef<n> for six pixel circuits or one Vef<n> for twelve pixel circuits etc. In a case where Vef<n> is used to sense potentials at second nodes, if a short circuit occurs at a second transistor T2 of a certain one of sub-pixel circuits, it may cause the reference voltage Vef<n> for a current column to be charged all the time during the sensing period. This results in an error in sensing of other sub-pixel driving circuits in this column, which causes bad effects such as dark lines in the column, and thus mutual influence between the sub-pixel circuits may exacerbate the decline in yield.

Figure 10:
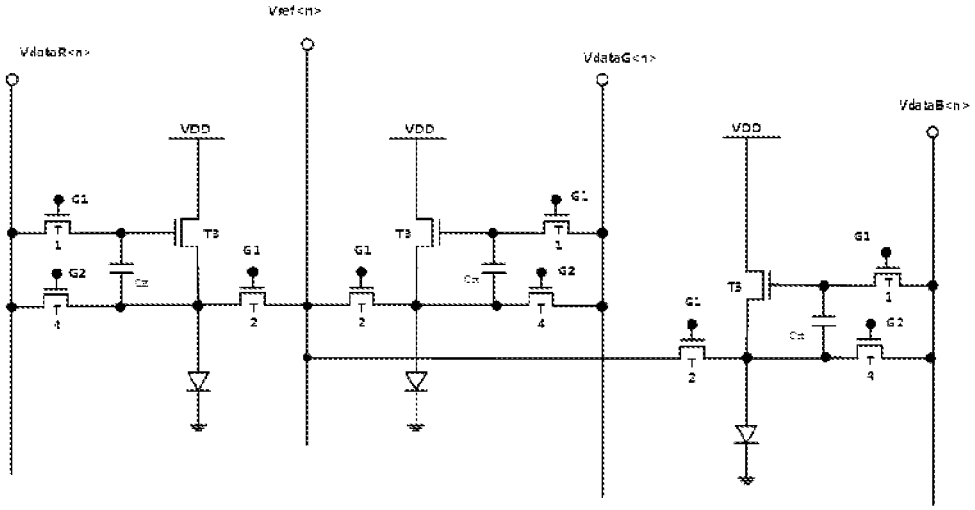
FIG. 10 is a schematic diagram of overall architecture of an $n^{th}$ column of pixels of the pixel circuit shown in FIG. 4.

In the present disclosure, the pixel driving circuit shown in FIG. 8 is used, architecture of an $n^{th}$ column of pixels of the pixel driving circuit may be known with reference to FIG. 10, and the second sensing sub-circuit (for example, the third transistor T3) of the pixel driving circuit is connected to the data signal terminal, which separates the influence of other bad sub-pixel driving circuits on the sensing period, improves the accuracy of compensation, effectively optimizes the compensation function, and improves the product yield.

In the present embodiment, when the first transistor and the second transistor are turned on under control of the first control terminal, the first data voltage at the data signal terminal is transmitted to the first node, and the voltage at the second node is maintained to be at low level. When the first transistor is turned off under control of the first control terminal and the third transistor is turned on under control of the second control terminal, the first power supply terminal charges the second node. When the first transistor is turned off under control of the first control terminal and the third transistor is turned off under control of the second control terminal, the voltage at the second node which is associated with the threshold voltage of the driving transistor is transmitted to the control IC through the second sensing signal terminal, to obtain the threshold voltage of the driving transistor. When the first transistor is turned on under control of the first control terminal and the third transistor is turned off under control of the second control terminal, threshold compensation is performed on the driving transistor based on the compensation voltage which is obtained according to the voltage associated with the threshold voltage of the driving transistor.

As shown in FIG. 5, an operation timing of the pixel circuit 800 in FIG. 8 may comprise two periods, which may be divided into a scanning period and a threshold voltage sensing period. Description will be made by taking an example of the transistors T1 to T3 and DT in the pixel circuit according to the embodiments of the present disclosure being all N-type thin film transistors and being turned on when a signal thereof at a high level is an effective signal. During the scanning period, when an input signal at the first control terminal G1 is at a high level (for example, during a phase t1 in FIG. 5), the first transistor T1 is turned on, and the data signal terminal Data inputs a first data voltage (for example, an image signal to be displayed) having a voltage value of Vdata1, and provides the first data voltage to the first node N1. While the first transistor T1 is turned on, the second transistor T2 is also turned on. At this time, the first data voltage is written into one terminal of the storage capacitor Cst, and is applied to a gate of the driving transistor DT at the same time, so that the driving transistor DT is turned on, to drive a light-emitting unit to emit light. Then, the input signal at the first control terminal G1 is at a low level, the first transistor T1 and the second transistor T2 are turned off at this time, a channel between the data signal terminal Data and the storage capacitor Cst is turned off, and the driving transistor DT is maintained to be turned on and the light-emitting unit is maintained to emit light at this time under the action of the storage capacitor Cst, thereby displaying a picture.

With reference to FIG. 5 here, the threshold voltage sensing period comprises: a phase t2, a phase t3, a phase t4, and a phase t5. In FIG. 5, the phase t3, the phase t2, the phase t4 and the phase t5 occur in a chronological order, and details of theses phases are as follows.

During the phase t3, the input signal at the first control terminal G1 is at a high level, the input signal at the second control terminal G2 is at a low level, and the first transistor T1 is turned on, so that a second data voltage (for example, a preset second data voltage) input at the data signal terminal Data, having a voltage value of Vdata2, is provided to the first node N1. At this time, the second data voltage is written into one terminal of the storage capacitor Cst, so that a voltage across the storage capacitor Cst is the same as Vdata2, and the second data voltage is applied to the gate of the driving transistor DT at the same time. While the first transistor T1 is turned on, the second transistor T2 is also turned on. At this time, the second terminal of the second selection switch M2 is connected to the direct current signal terminal VC, so that a signal Vc at the direct current signal terminal VC may be provided to the second node N2 through the second sensing signal terminal Sense 2 to maintain the voltage at the second node N2 to be at a fixed level (for example, a low level). When a difference between Vdata2 and the voltage at the second node N2 is greater than the threshold voltage Vth of the driving transistor, the driving transistor DT is turned on.

During the phase t2, the input signal at the first control terminal G1 is at a low level, the input signal at the second control terminal G2 is at a high level, the first transistor T1 and the second transistor T2 are turned off, and the third transistor T3 is turned on. Since the driving transistor DT is turned on, the first power supply VDD may charge the second node N2, so that the voltage at the second node is associated with the threshold voltage Vth of the driving transistor. In an embodiment, driving current (i.e., current at the second node N2) of the driving transistor DT for driving the light-emitting unit should be $I=k(Vgs-vth)^2$, wherein Vgs is a gate-source voltage of the driving transistor DT, and Vth is the threshold voltage of the driving transistor DT. At this time, the first sensing signal terminal Sense 1 is in a floating state. In an embodiment, Vgs is Vdata2.

During the phase t4, the input signal at the first control terminal G1 is at a low level, the input signal at the second control terminal G2 is at a low level, the first transistor T1, the second transistor T2 and the third transistor T3 are all turned off, and the voltage at the second node N2 is equal to Vdata2−Vth at this time. The first sensing signal terminal Sense 1 senses the voltage at the second node N2. At this time, the second terminal of the first selection switch is connected to the control IC to provide the voltage at the second node N2 which is sensed at the first sensing signal terminal Sense 1 to the control IC. The control IC converts this voltage into a digital signal, stores the digital signal in a memory cell, and obtains the threshold voltage Vth of the driving transistor DT.

During the phase t5, the input signal at the first control terminal G1 is at a high level, the input signal at the second control terminal G2 is at a low level, the first transistor T1 and the second transistor T2 are turned on, and the third transistor T3 is turned off. The first transistor T1 is turned on, the data signal terminal Data inputs a third data voltage having a voltage value which is a data voltage Vdata1 during a previous scanning period plus the previously obtained Vth, and the third data voltage is provided to the first node N1 to control the driving transistor DT to be turned on. At this time, the first sensing signal terminal Sense 1 is in a floating state. In an embodiment, the driving transistor DT is turned on under the action of the third data voltage, to drive the light-emitting unit to emit light.

It should be illustrated that, during the phase t3, the second data voltage Vdata2 input at the data signal terminal Data may be a fixed voltage, and ensures that the light-emitting unit does not emit light during this phase, and therefore the second data voltage Vdata2 may be, for example, about 5V. The third data voltage input at the data signal terminal Data during the phase t5 is a compensation voltage which is obtained according to the first data voltage Vdata1 and the threshold voltage Vth which is previously obtained by the control IC, so that the light-emitting unit emits light, and the third data voltage may be compared with a threshold voltage which is obtained during a current threshold voltage sensing period. In addition, the threshold voltage which obtained during the current threshold voltage sensing period is used to realize the threshold voltage compensation on the driving transistor during a subsequent scanning period.

In an embodiment of the present application, when the first transistor and the second transistor are turned on under control of the first control terminal, the first data voltage at the data signal terminal is transmitted to the first node, and the voltage at the second node is maintained to be at a low level. When the first transistor is turned off under control of the first control terminal and the third transistor is turned on under control of the second control terminal, the first power supply terminal charges the second node. When the first transistor is turned off under control of the first control terminal and the third transistor is turned off under control of the second control terminal, the voltage at the second node which is associated with the threshold voltage of the driving transistor is transmitted to the control IC through the first sensing signal terminal to obtain the threshold voltage of the driving transistor. When the first transistor is turned on under control of the first control terminal and the third transistor is turned off under control of the second control terminal, threshold compensation is performed on the driving transistor based on the compensation voltage which is obtained according to the voltage associated with the threshold voltage of the driving transistor.

In the embodiment of the present application, the third transistor is added, the first control terminal G1 is used to control both the first transistor and the second transistor, the second control terminal G2 is used to control the third transistor, and the third transistor only needs to be turned on once when a row of pixels where the pixel circuit is located is selected during the threshold voltage sensing period, so as to sense the threshold voltage of the driving transistor without progressive shift design for the control signal of the third transistor. In the present application, there is no need to make progressive shift design for the control signal of the third transistor, which greatly reduces a layout space occupied by the driving circuit of the pixel circuit, so that not only a narrow bezel of the product may be realized, but also the cost may be reduced.

In addition, as shown in FIG. 6, illustrated is a timing diagram of shutdown sensing of the pixel circuit 800 shown in FIG. 8 of the present application. In an embodiment, shutdown sensing refers to threshold sensing which is performed in a case where a display device is shut down (for example, the display device does not actually display a picture). As shown in FIG. 6, during a shutdown sensing period, the input signal at the second control terminal G2 is always at a low level, that is, the third transistor T3 is always maintained to be turned off. The first control terminal G1 is at a high level when a row of pixels where the pixel circuit is located is selected, so as to drive the first transistor T1 and the second transistor T2 to be turned on, and read a shutdown measurement signal. At this time, the second terminal of the second selection switch is connected to the control IC to output the voltage at the second node associated with the threshold voltage of the driving transistor, which is sensed at the second sensing signal terminal, to the control IC, to obtain the threshold voltage of the driving transistor. In a specific implementation, when the display device is turned on for display, the threshold voltage of the driving transistor which is obtained during the shutdown sensing period may be used to realize the threshold voltage compensation on the pixel circuit.

It should be illustrated that, during the shutdown sensing period, the second control terminal G2 is always at a low level, so that threshold voltage sensing may be performed on each row of pixels during the shutdown sensing period. In addition, during the shutdown sensing period, the shutdown measurement signal input at the data signal terminal Data is, for example, 3V, and the voltage input to the control IC may be Vdata-Vth. This simplifies an algorithm for obtaining the threshold voltage Vth.

Figure 12:
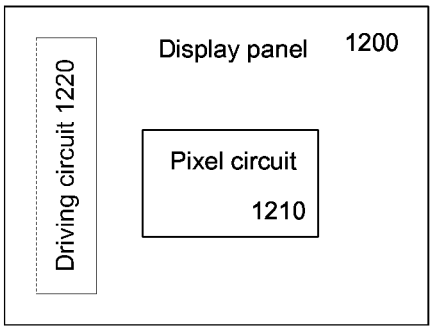
FIG. 12 is a schematic structural diagram of a display panel according to an embodiment of the present disclosure.

The embodiments of the present disclosure further propose a display panel. As shown in FIG. 12, the display panel 1200 comprises the pixel circuit 1210 described above and a driving circuit 1220.

In an embodiment, the first sensing sub-circuit in the pixel circuit is connected to the second sensing signal terminal, and first sensing sub-circuits of different columns of pixel circuits are connected to the same second sensing signal terminal. In an embodiment, the pixel circuit comprises an R sub-pixel circuit, a B sub-pixel circuit, and a G sub-pixel circuit, which are connected to the same second sensing signal terminal.

In the display panel 1200 according to the embodiment of the present disclosure, with the pixel circuit 1210, a layout space occupied by the pixel circuit is greatly reduced, so that not only a narrow bezel of the product may be realized, but also the cost may be reduced.

Figure 13:
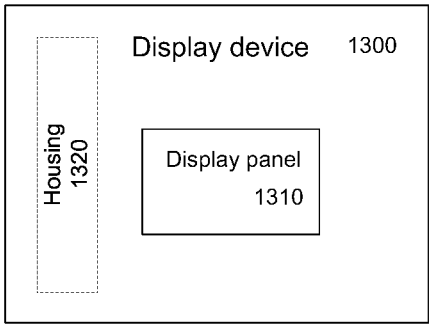
FIG. 13 is a schematic structural diagram of a display device according to an embodiment of the present disclosure.

The embodiments of the present disclosure further propose a display device. As shown in FIG. 13, the display device 1300 comprises the display panel 1310 described above and a housing 1320.

In the display device according to the embodiment of the present disclosure, with the display panel described above, a layout space occupied by the pixel circuit is greatly reduced, so that not only a narrow bezel of the product may be realized, but also the cost may be reduced.

Figure 14:
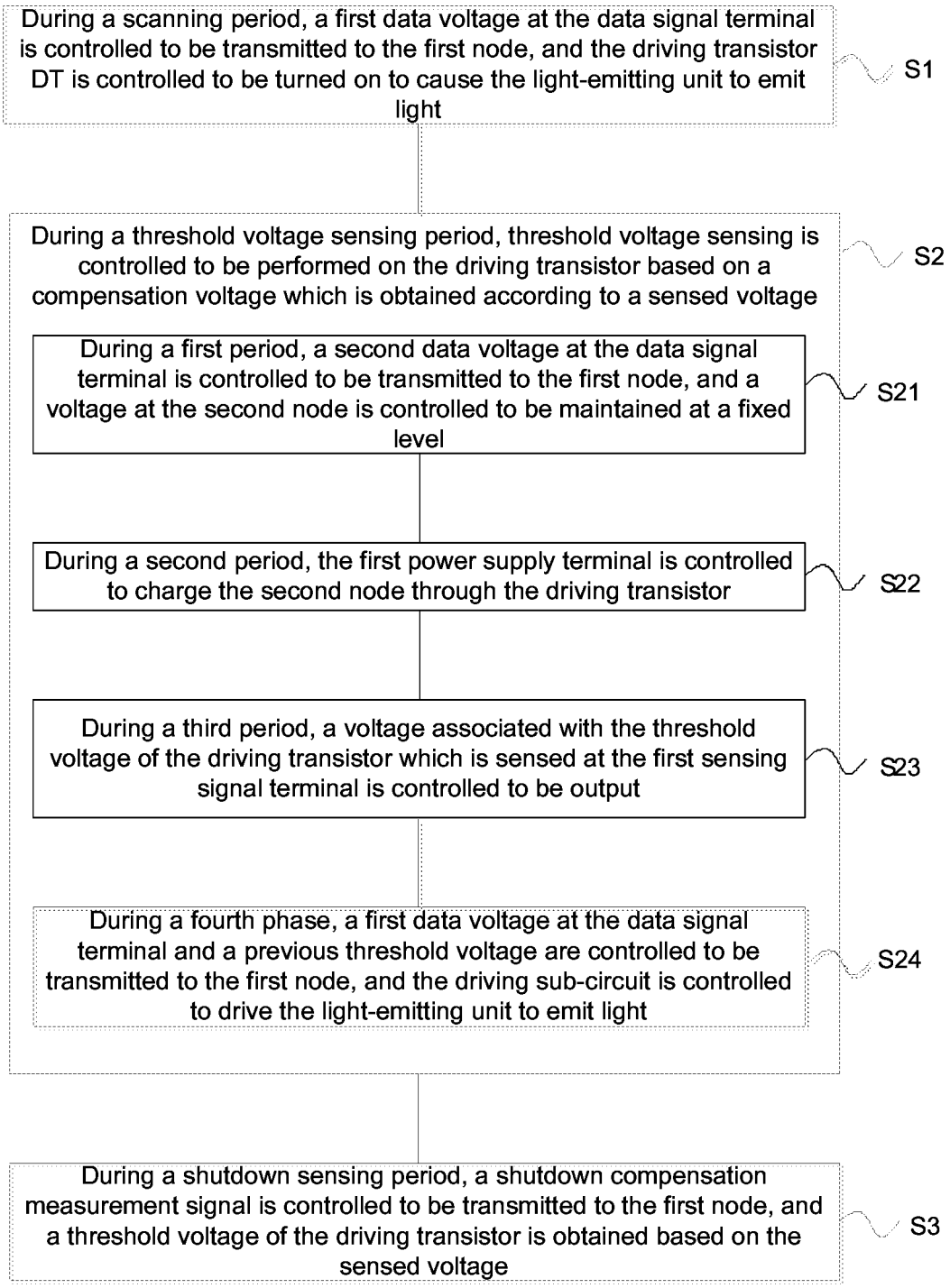
FIG. 14 is a method of controlling a pixel circuit according to an embodiment of the present disclosure.

The embodiments of the present disclosure further propose a method of controlling the pixel circuit described above, as shown in FIG. 14, comprising the following steps.

In step S1, during a scanning period, a first data voltage at the data signal terminal is controlled to be transmitted to the first node, and the driving transistor DT is controlled to be turned on to cause the light-emitting unit to emit light.

In step S2, during a threshold voltage sensing period, threshold voltage sensing is controlled to be performed on the driving transistor based on a compensation voltage which is obtained according to a sensed voltage.

In step S3, during a shutdown sensing period, a shutdown compensation measurement signal is controlled to be transmitted to the first node, and a threshold voltage of the driving transistor is obtained based on the sensed voltage.

In an embodiment, during the threshold voltage sensing period, the following steps are further included.

In step S21, during a first period, a second data voltage at the data signal terminal is controlled to be transmitted to the first node, and a voltage at the second node is controlled to be maintained at a fixed level.

In step S22, during a second period, the first power supply terminal is controlled to charge the second node through the driving transistor.

In step S23, during a third period, a voltage associated with the threshold voltage of the driving transistor which is sensed at the first sensing signal terminal is controlled to be output.

In step S24, during a fourth phase, a first data voltage at the data signal terminal and a previous threshold voltage are controlled to be transmitted to the first node, and the driving sub-circuit is controlled to drive the light-emitting unit to emit light.

The method of controlling a pixel circuit according to the embodiment of the present disclosure has similar implementation principles and effects as those of the pixel circuit provided above, and will not be described in detail here.

In the description of the present specification, the description made with reference to the terms "one embodiment", "some embodiments", "an example", "a specific example", or "some examples" etc. means that a specific feature, structure, material or characteristics described in conjunction with the embodiment or example is included in at least one embodiment or example of the present disclosure. In the present specification, schematic expressions of the above terms do not necessarily have to refer to the same embodiment or example. Furthermore, the specific feature, structure, material, or characteristics described may be combined in any suitable manner in any one or more embodiments or examples. In addition, those skilled in the art can combine and merge different embodiments or examples described in the present specification and features in different embodiments or examples without conflicting with each other.

Any process or method described in the flowcharts or described elsewhere herein may be construed as meaning modules, sections, or portions including codes of executable instructions of one or more steps for implementing a custom logic function or process. Further, the scope of the implementations of the present disclosure includes additional implementations in which functions may be performed in a substantially simultaneous manner or in a reverse order, depending on the functions involved, instead of the order shown or discussed, which should be understood by those skilled in the art to which the embodiments of the present disclosure pertain.

A logic and/or steps represented in the flowcharts or otherwise described herein, for example, may be considered as a sequence listing of executable instructions for implementing logical functions, and may be embodied in any computer-readable medium for use by an instruction execution system, apparatus or device (for example, a computer-based system, a system including a processor or other systems which may obtain instructions from the instruction execution system, apparatus or device and may execute the instructions), or may be used in combination with the instruction execution system, apparatus or device. As for this specification, a "computer-readable medium" may be any means which may contain, store, communicate, propagate, or transmit programs for use by or in connection with the instruction execution system, apparatus, or device. More specific examples (non-exhaustive lists) of the computer-readable media include an electrical connection part (an electronic apparatus) having one or more wirings, a portable computer disk cartridge (a magnetic apparatus), a Random Access Memory (RAM), a Read Only Memory (ROM), an Erasable and Programmable Read Only Memory (an EPROM) or a flash memory, a fiber optic apparatus, and a portable Compact Disc-Read Only Memory (CD-ROM). In addition, the computer-readable media may even be paper or other suitable medium on which the programs may be printed, as the programs may be obtained electronically by optically scanning the paper or the other medium and then editing, interpreting, or performing other suitable processing (if necessary) on the paper or the other medium, and then the programs are stored in a computer memory.

It should be understood that portions of the present disclosure may be implemented in hardware, software, firmware, or a combination thereof. In the above embodiments, a plurality of steps or methods may be implemented using software or firmware stored in a memory and executed by a suitable instruction execution system. For example, if implemented in hardware, as in another implementation, it can be implemented using any one or a combination of the following techniques known in the art: discrete logic gates having logic gate circuits for implementing logic functions on data signals, an application-specific integrated circuit having a suitable combinational logic gate circuit, a Programmable Gate Array (PGA), a Field Programmable Gate Array (FPGA), etc.

It can be understood by those of ordinary skill in the art that all or a part of steps for implementing the method according to the embodiments may be completed by programs instructing a related hardware. The programs may be stored in a computer-readable storage medium. When executed, the programs include one or a combination of the steps for implementing the method embodiments.

In addition, various functional units in various embodiments of the present disclosure may be integrated in one processing module, or may exist alone physically, or two or more units may be integrated in one module. The integrated module may be implemented in a form of hardware or in a form of a software functional module. The integrated module may also be stored in a computer readable storage medium if it is implemented in a form of a software functional module and sold or used as an independent product.

The storage medium mentioned above may be a ROM, a magnetic disc, or an optical disc etc. Although the embodiments of the present disclosure have been illustrated and described above, it can be understood that the above embodiments are exemplary and may not be to be construed as limiting the scope of the disclosure. Changes, modifications, substitutions and variations can be made to the above embodiments by those of ordinary skill in the art within the scope of the present disclosure.

We claim:

1. A pixel circuit, comprising:

a light-emitting control sub-circuit connected to a data signal terminal, a first control terminal and a first node, and configured to transmit a data voltage at the data signal terminal to the first node under control of the first control terminal;

a driving sub-circuit connected to the first node, a first power supply terminal and a second node, and configured to transmit a first power supply voltage at the first power supply terminal VDD to the second node N2 under control of a voltage at the first node;

a first sensing sub-circuit connected to the first control terminal, the second node and a first sensing signal terminal, and configured to maintain a voltage at the second node to be at a fixed level under control of the first control terminal;

a second sensing sub-circuit connected to a second control terminal, the first sensing signal terminal and the second node, and configured to transmit the voltage at the second node to the first sensing signal terminal under control of the second control terminal, so that the first sensing signal terminal senses a voltage associated with a threshold voltage of the driving sub-circuit, and a light-emitting unit having an anode connected to the second node, and a cathode connected to a ground terminal, wherein the first control terminal and the second control terminal are driven by different control signals, and the light-emitting control sub-circuit performs threshold voltage compensation on the driving sub-circuit based on a compensation voltage which is obtained according to the voltage sensed at the first sensing signal terminal under control of the first control terminal.

2. The pixel circuit according to claim 1, further comprising: a first external control circuit having a first terminal connected to the first sensing signal terminal, and a second terminal connected to the data signal terminal, the first external control circuit being configured to assist in performing external threshold voltage compensation on the pixel circuit.

3. The pixel circuit according to claim 2, wherein the first external control circuit comprises a first selection switch, a first direct current signal terminal, and a first control Integrated Circuit (IC), wherein:

the first selection switch has a first terminal connected to the first sensing signal terminal, and a second terminal selectively connected to the direct current signal terminal and a first terminal of the first control IC, and is configured to transmit the voltage sensed at the first sensing signal terminal to the first control IC, or transmit a signal at the direct current signal terminal to the first sensing signal terminal; and a second terminal of the first control IC is connected to the data signal terminal, and the first control IC is configured to obtain the compensation voltage according to the voltage sensed at the first sensing signal terminal and provide the compensation voltage to the data signal terminal.

4. The pixel circuit according to claim 1, wherein the first sensing signal terminal and the data signal terminal are the same signal terminal.

5. The pixel circuit according to claim 4, further comprising a second sensing signal terminal connected to the first sensing sub-circuit.

6. The pixel circuit according to claim 5, further comprising: a second external control circuit having a first terminal connected to the second sensing signal terminal and a second terminal connected to the data signal terminal, the second external control circuit being configured to assist in performing external threshold voltage compensation on the pixel circuit.

7. The pixel circuit according to claim 6, wherein the second external control circuit comprises a second selection switch, a second direct current signal terminal, and a second control IC, wherein:

the second selection switch has a first terminal connected to the second sensing signal terminal, and a second terminal selectively connected to the second direct current signal terminal and a first terminal of the second control IC, and the second selection switch is configured to transmit a voltage sensed at the second sensing signal terminal to the second control IC during a shutdown sensing phase, or transmit a signal at the second direct current signal terminal to the second sensing signal terminal during a scanning phase; and a second terminal of the second control IC is connected to the data signal terminal, and the second control IC is configured to obtain a compensation voltage according to the voltage sensed at the second sensing signal terminal and provide the compensation voltage to the data signal terminal.

8. The pixel circuit according to claim 6, further comprising: a third external control circuit which comprises a third selection switch and a third control IC, wherein:

the third selection switch has a first terminal connected to the first sensing signal terminal, and a second terminal selectively connected to the first sensing signal terminal and a first terminal of the third control IC, and is configured to transmit the voltage sensed at the first sensing signal terminal to the third control IC; and a second terminal of the third control IC is connected to the first sensing signal terminal, and the third control IC is configured to obtain the compensation voltage according to the voltage sensed at the first sensing signal terminal and provide the compensation voltage to the data signal terminal.

9. The pixel circuit according to claim 1, wherein the light-emitting control sub-circuit comprises:

a first transistor having a control electrode connected to the first control terminal, a first electrode connected to the data signal terminal, and a second electrode connected to the first node; and a storage capacitor having a first terminal connected to the first node and a second terminal connected to the second node.

10. The pixel circuit according to claim 1, wherein the driving sub-circuit comprises:

a driving transistor having a control electrode connected to the first node, a first electrode connected to the first power supply terminal, and a second electrode connected to the second node.

11. The pixel circuit according to claim 1, wherein the first sensing sub-circuit comprises:

a second transistor having a control electrode connected to the first control terminal, a first electrode connected to the second node, and a second electrode connected to the first sensing signal terminal.

12. The pixel circuit according to claim 1, wherein the second sensing sub-circuit comprises:

a third transistor having a control electrode connected to the second control terminal, a first electrode connected to the second node, and a second electrode connected to the first sensing signal terminal.

13. A display panel, comprising a plurality of pixel circuits according to claim 1 arranged in a matrix and a gate driving circuit.

14. The display panel according to claim 13, wherein the pixel circuit further comprises a second sensing signal terminal connected to the first sensing sub-circuit, and first sensing sub-circuits of different columns of pixel circuits are connected to the same second sensing signal terminal.

15. The display panel according to claim 14, wherein the pixel circuit comprises an R sub-pixel circuit, a B sub-pixel circuit, and a G sub-pixel circuit, which are connected to the same second sensing signal terminal.

16. A display device, comprising: a housing and the display panel according to claim 13.

17. A method of controlling the pixel circuit according to claim 1, comprising:

controlling, during a scanning period, to transmit a first data voltage at the data signal terminal to the first node, and controlling the driving sub-circuit to drive the light-emitting unit to emit light; and controlling, during a threshold sensing period, to perform threshold voltage sensing on the driving transistor based on a compensation voltage which is obtained according to a sensed voltage.

18. The method according to claim 17, wherein during the threshold sensing period, the method further comprises:

controlling, during a first phase, a second data voltage at the data signal terminal to be transmitted to the first node, and controlling a voltage at the second node to be maintained at a fixed level;

controlling, during a second phase, the first power supply terminal to charge the second node through the driving sub-circuit;

controlling, during a third phase, the sensed voltage which is associated with the threshold voltage of the driving transistor to be output; and controlling, during a fourth phase, the first data voltage at the data signal terminal and a previous threshold voltage to be transmitted to the first node, and controlling the driving sub-circuit to drive the light-emitting unit to emit light.

19. The method according to claim 18, further comprising:

controlling, during a shutdown sensing period, to transmit a shutdown compensation measurement signal to the first node, and to obtain the threshold voltage of the driving transistor based on the sensed voltage.

* * * * *